United States Patent [19]

Schuman

[11] Patent Number: 4,589,600

[45] Date of Patent: May 20, 1986

[54] CONE CRUSHER

[75] Inventor: LeRoy Schuman, Milwaukee, Wis.

[73] Assignee: Lippman-Milwaukee, Inc., Cudahy, Wis.

[21] Appl. No.: 771,135

[22] Filed: Aug. 28, 1985

Related U.S. Application Data

[63] Continuation of Ser. No. 612,693, May 21, 1984, abandoned, which is a continuation of Ser. No. 338,273, Jan. 11, 1982, abandoned.

[51] Int. Cl.[4] ..... B02L 2/04

[52] U.S. Cl. ..... 241/215; 241/208

[58] Field of Search ..... 241/207-216, 241/286, 290

[56] References Cited

U.S. PATENT DOCUMENTS

| | | | |
|---|---|---|---|
| 2,305,616 | 12/1942 | Gruender | 241/216 X |
| 3,887,143 | 6/1975 | Gilbert et al. | 241/215 |
| 4,391,414 | 7/1983 | Reiter | 241/213 |
| 4,512,525 | 4/1985 | Cameron | 241/207 |

*Primary Examiner*—Howard N. Goldberg

*Assistant Examiner*—Timothy V. Eley

*Attorney, Agent, or Firm*—Ronald E. Barry

[57] ABSTRACT

A gyratory cone crusher having an eccentric member mounted for rotary motion on a spindle, the eccentric member having a lower skirt surrounding the spindle and an upper cylindrical portion extending upward from the spindle, the eccentric member being supported on the spindle by a V-flat thrust bearing located at the bottom of the skirt and a pair of radial bearings located inside of the skirt, a tapered crusher head is mounted on the eccentric member for gyratory motion within a bowl assembly, the crusher head is supported on the eccentric member by a radial bearing surrounding the cylindrical portion of the eccentric member, a thrust bearing surrounding the skirt, all of the radial bearings being interchangeable and the outside diameter of the thrust bearing being greater than the outside diameter of the V-flat thrust bearing, and a hydropneumatic piston and cylinder assembly for holding the crusher head on the base, the hydropneumatic assembly having a control circuit for selectively relieving the holding force on the hydropneumatic assembly.

15 Claims, 3 Drawing Figures

156
152
150
154
158
160
184
180
164
162
166
186
188
176
178
182
171
165
190
168
174
169
194
192
170

CONE CRUSHER

This is a continuation of co-pending application Ser. No. 612,698, now abandoned, filed on May 21, 1984 which is a continuation of application Ser. No. 338,273, now abandoned, filed on Jan. 11, 1982.

BACKGROUND OF THE INVENTION

In my co-pending applications, Ser. No. 120,708 filed Feb. 11, 1980, and Ser. No. 310,059 filed Oct. 9, 1981 entitled "Gyratory Cone Crusher" a cone crusher is described which includes tapered roller bearings which are stacked up on assembly and adjusted by incorporating shims into the assembly to provide proper tolerances. These applications also include improved oil lubricating systems for the bearings as well as anti-rotation devices for preventing rotation of the cone with respect to the eccentric member. Although this arrangement has operated successfully, certain improvements have been made in the assembly procedure and the control feature to improve its operation.

SUMMARY OF THE INVENTION

The gyratory cone crusher of the present invention has been designed for ease of assembly by the elimination of the shims as used in my earlier co-pending applications. This has been accomplished by substituting straight radial roller bearing assemblies for the tapered bearing assemblies at the upper end of the eccentric member for supporting the crusher head as well as the upper end of the spindle for supporting the eccentric member. The thrust bearing has been moved to a position within the drive ring and is mounted on the shaft in order to take the thrust of the eccentric member and gyratory cone crusher on a fixed portion of the base thus eliminating the carrier ring. This bearing is a V-flat type thrust bearing having its upper bearing surface located in a planer relation to the bottom of the eccentric member so that it takes a straight thrust force. Another advantage of the present design is the ability to observe the back face of the gear and pinion drive for the eccentric member thus making it easier for setting of the pitch cones.

An improved pressure control is also provided for maintaining the crushing force on the crusher head assembly and for responding to increased loads for relieving the crushing force in the event of a "digout". The control system makes it possible to quickly and easily empty the cone crusher in the event of a "digout". This is accomplished by relieving pressure on the bowl assembly and for intermittently rotating the crusher head assembly.

DESCRIPTION OF THE INVENTION

Figure 1:
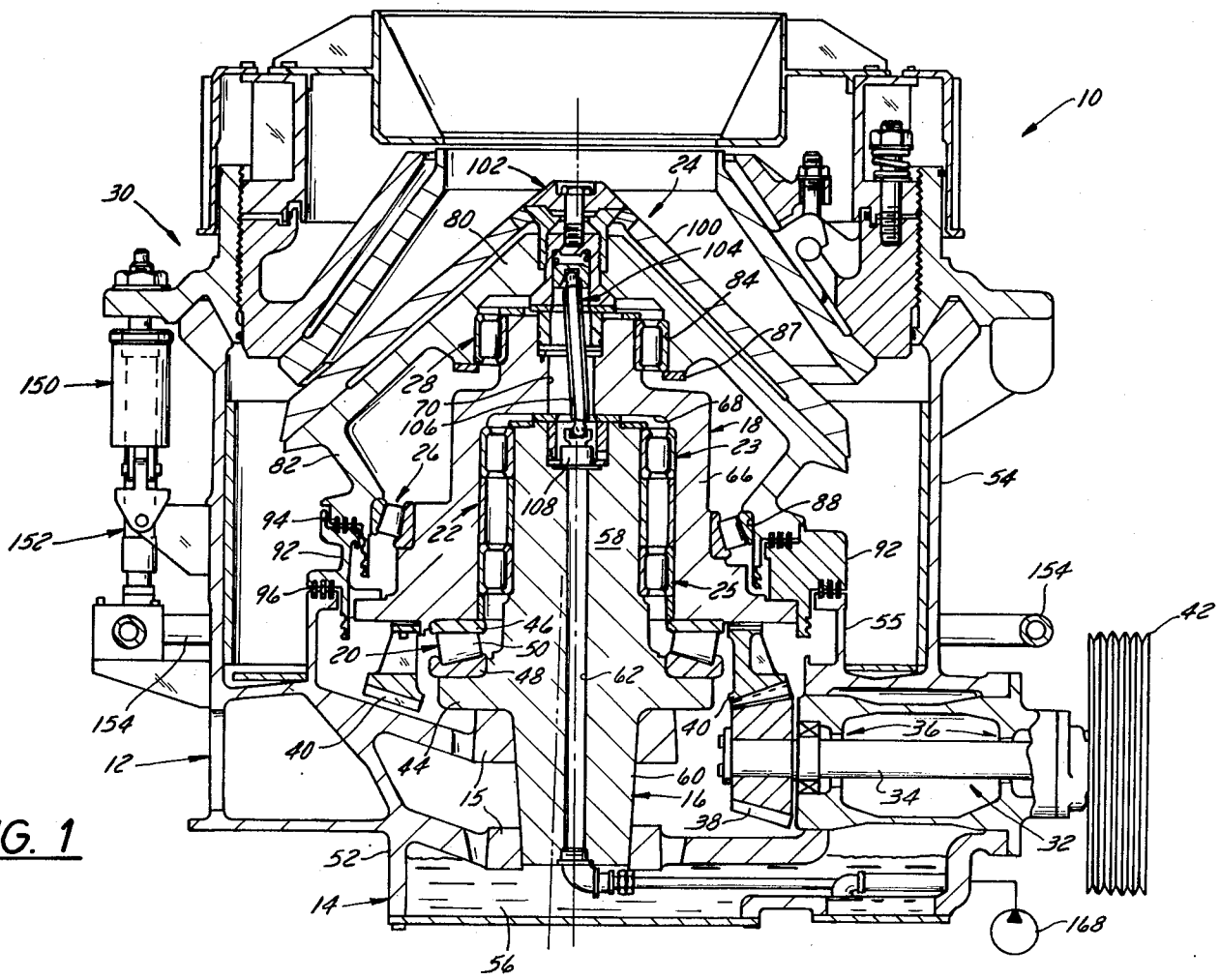
FIG. 1 is an elevation view in section showing the gyratory cone crusher according to the invention.
Figure 2:
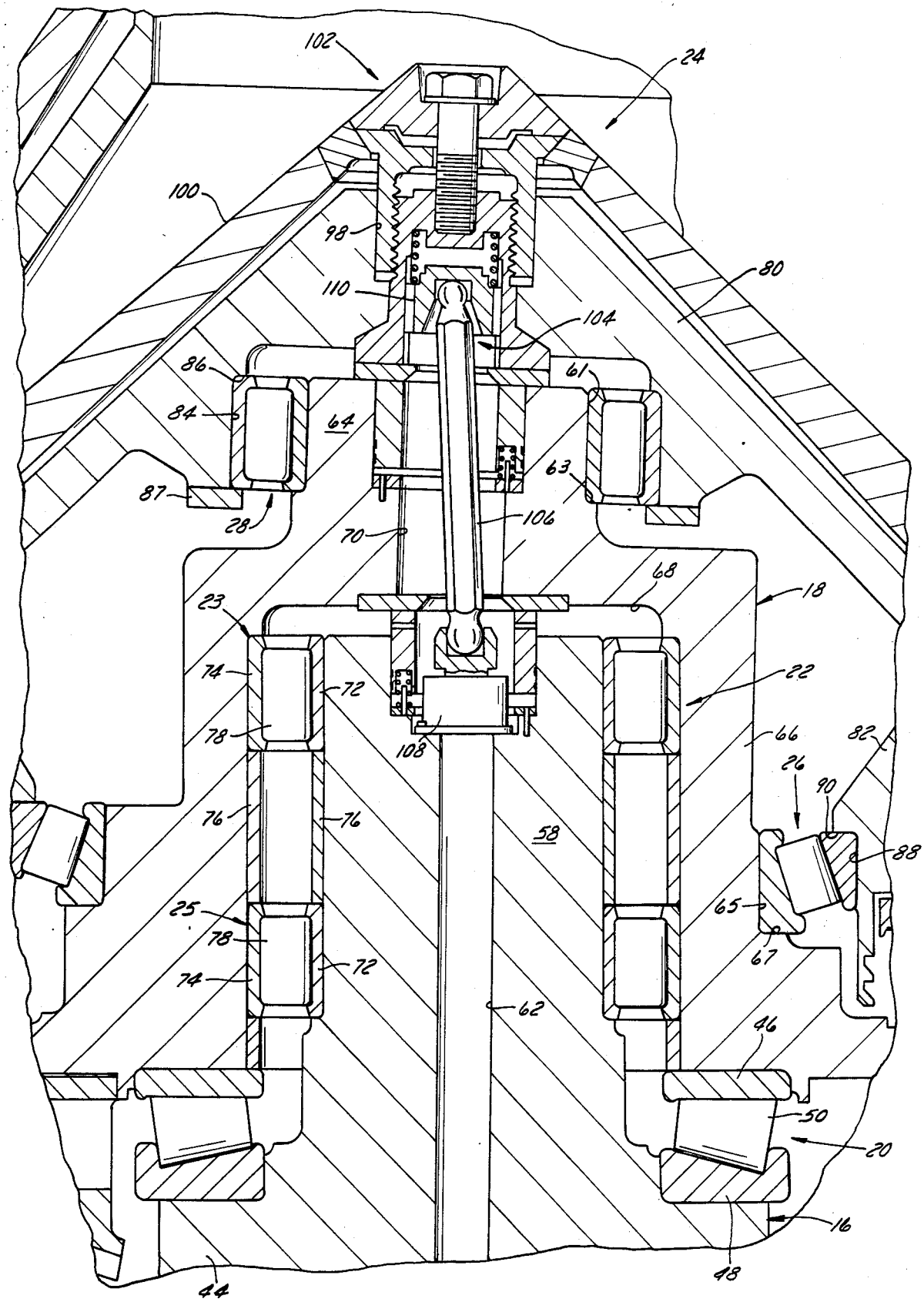
FIG. 2 is an enlarged view of a portion of the cone crusher shown in FIG. 1.

The gyratory cone crusher 10 according to the present invention includes a main frame or housing 12 having a base 14 for supporting a spindle or shaft 16 in a fixed position within the main frame. An eccentric member 18 is supported for rotary movement on the spindle 16 by means of a thrust bearing assembly 20 and a radial bearing assembly 22. A crusher head assembly 24 is supported on the eccentric member 18 by means of a thrust bearing assembly 26 and a radial bearing assembly 28 for gyratory motion within a bowl assembly 30 supported on the main frame 12 above the crusher head assembly 24. Means are provided for rotating the eccentric member 18 on the spindle 16 in the form of a drive assembly 32 mounted in the main frame 12.

In this regard, the drive assembly 32 includes a shaft 34 mounted for rotary motion in bearing assemblies 36 located in the main frame 12. A bevel gear 38 is provided on the inner end of the shaft 34 in a position to engage a beveled ring gear 40 secured to the eccentric member 18 radially outwardly from the bearing assembly 20. The shaft 34 can be driven by any power source to impart rotary motion to a drive wheel 42 mounted on the outer end of the shaft 34.

In accordance with one aspect of the invention, the entire weight of the eccentric member and crusher head is carried by means of the thrust bearing assembly 20. In this regard, the bearing assembly 20 is shown mounted on a radial bearing surface flange 44 provided on the spindle 16. The bearing assembly 20 includes upper and lower bearing races 46 and 48 and a number of tapered roller bearings 50. The tapered roller bearings 50 are positioned between the races 46 and 48 to form a V-flat upper bearing surface wherein the upper bearing race 46 provides a flat planer surface which is supported on the tapered roller bearings 50. The V-flat type bearing assembly 20 provides more thrust bearing stability since load vectors from the tapered crusher head pass through the inside diameter of the bearing.

The bearing assembly 20 is concentric with the axis of the spindle 16 and bearing assembly 22. The axis of the bearing assembly 26 and the radial bearing assembly 28 are concentric to an axis oblique to the axis of the spindle 16. The outside diameter of the bearing assembly 26 is greater than the outside diameter of the bearing assembly 20.

As seen in FIG. 1 of the drawings, the main frame 12 includes a cylindrical sidewall 54 which extends upward from the base 14 to form a support for the assembly 30. The base 14 includes an oil sump 56 located generally below the spindle 16. The spindle 16 can be supported on the base 14 by means of spindle support rings 15 with the flanges 44 on the spindle resting on the upper support ring 15. A solid cast/weld spindle or an integral spindle can also be used.

The spindle 16 includes a main cylindrical section 58 and a lower conical section 60 which is separated from the upper section 58 by means of the flange 44. A central bore 62 is provided through the center of the spindle 16.

The eccentric member 18 includes an upper cylindrical section 64 and a lower annular skirt or tubular member 66 which defines a spindle cavity 68. A bore 70 is provided through the center of the upper section 64. A machined surface 61 is provided on the upper section 64 which terminates at a shoulder 63. A machined surface 65 is provided on the outside surface of the skirt 66 which terminates at a shoulder 67. The use of an inside-outside eccentric member 18 as described above provides increased stability because the greater weight of the member 18 is concentrated near the lower end. This type of eccentric member is also easier to balance because it allows for selective placement of less or more mass thereby reducing lead counterweight requirements and providing a smooth vibration free crushing action.

The eccentric member 18 is mounted on the spindle 16 and supported for rotary motion therein by means of the thrust bearing assembly 20 and the radial bearing assembly 22. In this regard, it should be noted that the bearing assembly 22 includes two separate radial bearings 23 and 25, each having inner and outer races 72 and 74, respectively, which are separated by means of spacer rings 76. Cylindrical rollers 78 are provided between the races 72 and 74.

After the eccentric member 18 has been mounted on the spindle 16, direct observation and feel of the backface of the ring gear 40 and pinion gear 38 can be made through the inner frame 55. Proper setting of the pitch cones and the specified backlash can be more easily achieved, thus overcoming the problems of the trial and error system previously used.

The crusher head assembly 24 includes a tapered head 80 and a depending flange 82 which forms a cavity for the eccentric member 18. A machined bore 84 is provided at the inner-upper portion of the head 80 which terminates at a shoulder 86. A second machined surface 88 is provided on the inside of the flange 82 which terminates at a shoulder 90. An axial bore 98 is provided through the upper end of the head 80.

The head 80 is supported on the eccentric member by means of bearing assemblies 26 and 28. The bearing assembly 28 is positioned in the bore 84 and is seated on the shoulder 86. A retainer ring 87 is used to hold the assembly 28 in the bore 84. The bearing assembly 26 is positioned on the machined surface 65 on the eccentric member 18 and is seated on the shoulder 67. The crusher head assembly is placed on the eccentric member 18 with the bearing assembly 26 abutting the shoulder 90 and the radial roller bearing assembly 28 mounted on the machined surface 61 and resting on shoulder 63.

One of the advantages of the above bearing arrangement is the ability to use the same size radial roller bearing for all three radial bearings 23, 25 and 28.

Means are provided at the lower edge of the flange 82 and the upper edge of the inner wall 55 of the frame 12 to seal the space around the eccentric member 18. Such means is in the form of a seal ring 92 having labyrinth seals 94 and 96.

The upper outer portion of the head 80 is provided with means for cooperating with the bowl assembly 30 for crushing rocks. Such means is in the form of a mantle or cone 100 made of work hardenable manganese steel positioned on the outer surface of the head 80. The mantle 100 is retained on the head 80 by a mantle nut assembly 102 in a conventional manner.

The head 80 is restrained from rotation with respect to the eccentric member 18 by means of an anti-spin mechanism 104 as described in my co-pending application Ser. No. 120,708. This mechanism includes a brake shaft 106 which extends through the opening 70 and the opening 98 in the head 80. One end of th shaft is operatively connected to a one-way clutch 108 secured to the upper end of the spindle 16 and the other end is seated in a socket member 110 which is keyed to the head 80.

The anti-spin mechanism 104 and the bearing assemblies 20, 22, 26 and 28 are lubricated by means of a pressurized oil system provided through the passage 62 in the spindle 16. The system operates in substantially the same way as disclosed in my co-pending application Ser. No. 120,708.

HYDROPNEUMATIC SPRING RELIEF SYSTEM

A hydropneumatic spring system commonly refers to a nitrogen over oil accumulator used in conjunction with oil filled cylinders to provide crushing force between the cone 100 on the gyratory head 80 and the crushing surface in the bowl assembly 30. These systems provide a twofold purpose in that the springs provide the necessary crushing force and at the same time provide protection from uncrushable or very hard material. If observed closely, a poor feed system can be detected if there is continued movement of the cylinders on one side of the crusher. If this unbalanced force continues to build up, the forces will adversely affect the bowl assembly.

Figure 3:
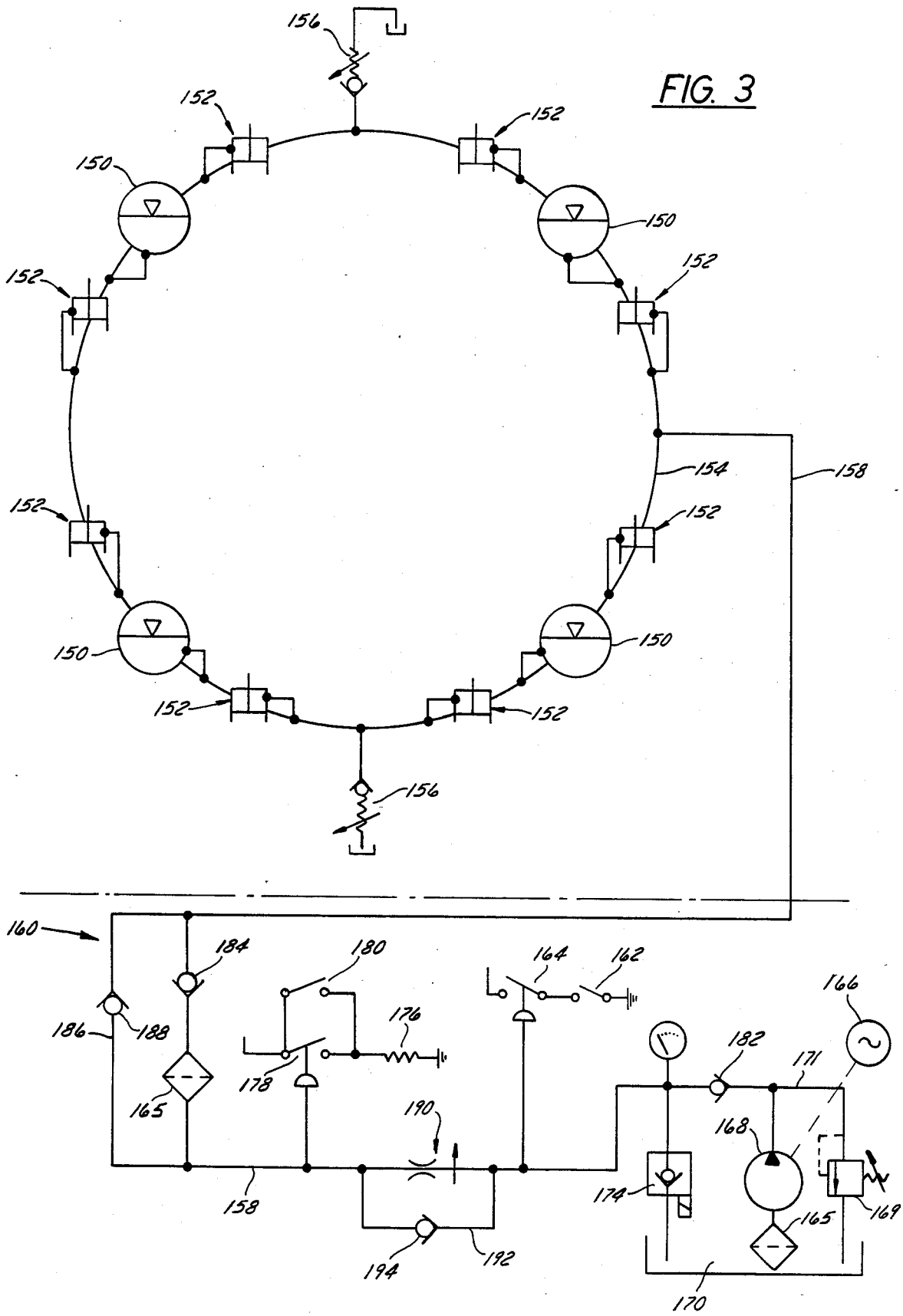
FIG. 3 is a schematic view of the hydropneumatic control system for the cone crusher.

The system used in the present invention as seen in FIG. 3 includes a plurality of accumulators 150 and a plurality of hydraulic piston and cylinder assemblies 152, all of which are connected to a common manifold 154 in a symetrical relation to the center line of the cone crusher. A pair of pressure relief valves 156 are connected to the manifold 154 at diametrically opposite sides of the cone crusher. The pressure relief valves, as more particularly described hereinafter, provide pressure relief of exceedingly high pressures developed in the manifold. The manifold is connected by means of a hydraulic line 158 to a control system 160 which is used to maintain pressure in the manifold above a specified pressure and to relieve pressure in the manifold if it exceeds a maximum limit. In the event the crusher head becomes buried necessitating a "digout", the pressure control circuit can be switched off and a manual bypass or drain solenoid energized to reduce manifold pressure to a low level.

The control system 160 includes a main switch 162 connected through a normally closed pressure switch 164 to an electric motor 166 for a pump 168. When the power switch 162 is turned on and no pressure is present in the line 158, the pump 168 will start operating drawing hydraulic fluid from the reservoir 170 and pumping it into the manifold 154 through the hydraulic line 158. Once pressure has been built up to the set operating pressure, the pressure switch 164 will open turning off the pump motor 166. Once the pressure switch 164 is open, it will remain open until the pressure in the manifold drops below minimum pressure.

Pressure can be relieved in the line 158 by means of a solenoid actuated one way normally closed valve 174 connected to the line 158. The one way valve 174 is opened by means of a solenoid coil 176 connected to the power source through a normally opened pressure responsive switch 178. If the pressure becomes too high, the pressure switch 178 will close activating the coil 176 and allowing the valve 174 to open to dump the oil back in to the reservoir 170. The pressure switch 178 is used to automatically protect the system from extremely high pressures due to large rises in temperature which can occur in the desert in the autumn or spring and also in the event the switch 164 becomes stuck in the closed position. Opening of the solenoid valve 174 allows hydraulic fluid in the system to return to the reservoir 170. A manual drain switch 180 can be connected parallel to the coil with the pressure switch 178 to manually drain the oil from the system when major repairs or services to the crusher are required.

A secondary pressure relief means is provided for both the manifold 154 and the pump 168. With respect to the manifold 154, such means is in the form of the two pressure relief valves 156. These valves are set at 100 PSI above the pressure setting for pressure responsive switch 178. With respect to the pump 168, a pressure responsive relief valve 169 is connected to the pump by line 171 to bypass hydraulic fluid directly to the reservoir if the pressure responsive switch 164 fails to deenergize the pump when the pressure in the line 158 exceeds the rated pressure of the pump by 100 PSI.

If for some reason the crusher has to be shut down, when crushing clay laden material or in the event an inadvertent stall occurs, the feed of material upstream continues to enter the crushing head cavity and sometimes will bury the crusher head necessitating a "dig-out." This normally requires a manual digging to clear the head assembly. With the present control system, power is turned off to the pump and then the solenoid valve coil 176 is energized to open the solenoid drain valve and drop the pressure in the manifold 154 to 400–500 psi. Then by jogging the main drive motor with the pressure switch off, the head assembly can be cleared in a matter of a few minutes. Once the head has been cleared, the power is restored and pressure to the system is returned to normal.

Means are provided for double filtering the hydraulic fluid to protect the hydropneumatic system. Such means is in the form of filters 165 provided on the pump 168 and on the line 158. Back flushing of the filters is prevented by one-way valves 182 and 184. Return flow of fluid from the manifold is bypassed around one-way valve 184 through a conduit 186 which includes a one-way valve 188. The rate of return flow is controlled by, means of a return flow control valve 190 to prevent erratic operation of the pressure switch 164. A bypass line 192 having a one-way valve 194 is provided around the flow control valve 190 for pressurizing the system.

I claim:

1. A gyratory cone crusher comprising a base;

a support member mounted on said base and projecting upwardly from said base; and an eccentric member mounted on said support member and having a first portion extended over and surrounding said support member and a second portion projecting upwardly from said support member, a thrust bearing mounted on said support member in a position to operatively engage the lower end of said eccentric member said thrust bearing transmitting all of the thrust loads from the eccentric member to said support member;

a radial bearing means mounted between the support member and said first portion of the eccentric member to take radial loading applied to the eccentric member, said radial bearing means having its axis common with the axis of said thrust bearing, whereby the thrust bearing and the radial bearing means enable said eccentric member to rotate on the support member;

a bevel ring gear mounted on the lower end of said first portion of said eccentric member radially outwardly of said thrust bearing;

a crusher head assembly extending around and over said eccentric member and having a generally conical upwardly presented crushing surface;

second bearing means between said eccentric member and said crusher head assembly to enable said eccentric member to rotate relative to the crusher head assembly, the axis of said second bearing means being inclined slightly with respect to the common axis of the thrust bearing and radial bearing means, whereby the crusher head assembly will wobble as the eccentric member revolves within the crusher head assembly;

a crusher bowl assembly enclosing said crusher head assembly and having an inlet opening located generally over the crusher head assembly and a conical crushing surface spaced from the conical crushing surface on the crusher head assembly, the crushing surface of the bowl assembly being generally fixed in position with respect to said eccentric member, whereby material introduced into the housing through the inlet will be crushed in the space between the crusher head assembly and the bowl assembly.

2. The crusher according to claim 1 wherein said second bearing means includes a tapered roller bearing surrounding the first portion of said eccentric member and a cylindrical roller bearing surrounding the second portion of said eccentric member, said tapered roller bearing and said cylindrical roller bearing being located within said crusher head assembly.

3. The crusher according to claim 2 wherein said radial bearing means includes upper and lower cylindrical radial roller bearings having the same dimension as the roller bearing in said second bearing means whereby said radial bearings are interchangeable.

4. The crusher according to claim 1 wherein said second bearing means includes a tapered roller bearing that surrounds the first portion of said eccentric member and is located above the thrust bearing, the tapered roller bearing of the second bearing means further being configured and positioned to transfer downwardly directly thrust loads from the crusher head assembly to the eccentric member.

5. The crusher according to claim 1, 2 or 4 wherein said thrust bearing comprises a V-flat type thrust bearing having the upper bearing surface located in a planar relation to said eccentric member.

6. A gyratory cone crusher comprising a housing including a base having an upwardly presented shaft;

an eccentric member supported on said shaft;

first bearing means for enabling the eccentric member to rotate relative to the shaft about an axis that is fixed in position with respect to the base and extends through the shaft, said first bearing means including a tapered roller thrust bearing mounted on the shaft and located below the eccentric member to support the eccentric member for rotary motion on the shaft, said thrust bearing carrying all of the thrust forces of the eccentric member;

means for rotating the rotable member;

a crusher head assembly positioned generally around and over the eccentric member, the crusher head assembly having an upwardly presented crushing surface;

second bearing means between the crusher head assembly and the eccentric member for supporting the crusher head assembly on the eccentric member and for enabling the eccentric member to rotate within the the crusher head assembly, the axis of the second bearing means being oblique to the fixed axis of the first bearing means, whereby the crusher head assembly will wobble as the eccentric member rotate;

said housing including a bowl assembly having an inlet located above the crusher head assembly so that material to be crushed may be directed through the inlet and toward the crusher head assembly;

said bowl assembly including a downwardly presented crushing surface located in a generally fixed position with respect to the crusher head assembly, the crushing surface of the bowl assembly being positioned in a spaced relation to the crushing surface on the crusher head assembly, and said housing including a number of hydraulic hold-down cylinders connected between said bowl assembly and said housing, a common manifold connected to said cylinders, a number of accumulators connected to said manifold, and control means for controlling the operating pressure of said cylinders, said control means including a hydraulic pump connected to said manifold, first switch means responsive to pressure in the manifold for controlling the operation of the pump, a solenoid controlled pressure relief valve connected to said manifold, and a second switch means responsive to manifold pressure operatively connected to said relief valve to relieve pressure in said manifold in the event of overload, whereby material which is introduced into the housing through the inlet will be crushed in the space between the two crushing surfaces as the crusher head wobbles.

7. The crusher according to claim 6 wherein said first bearing means includes a radial roller bearing between the shaft and eccentric member.

8. The crusher according to claim 7 wherein the second bearing means includes a tapered roller bearing positioned between the eccentric member and the crusher head.

9. The crusher according to claim 6 wherein said thrust bearing is a V-flat type bearing.

10. The crusher according to claim 6 or 9 wherein said rotating means includes a beveled ring gear mounted on the eccentric member radially outwardly from said thrust bearing.

11. A gyratory cone crusher comprising a housing having a fixed base and a removable crusher bowl assembly;

a shaft projecting upwardly from said base and being fixed in position with respect to the base;

an eccentric member mounted on said shaft and having a first portion surrounding said shaft and a second portion extending upwardly from said shaft, the diameter of said first portion being greater than the diameter of said second portion;

first bearing means enabling said eccentric member to rotate with respect to said shaft about the axis of the first bearing means, said first bearing means including a thrust bearing located between the lower end of said first portion of the eccentric member and said shaft so as to transmit all of the thrust loads from the eccentric member to said fixed shaft, the first bearing means also including radial bearing means located between said shaft and said first portion of the eccentric member, so as to transfer radial loads from the eccentric member to said shaft;

means for rotating said eccentric member, said rotating means including a ring gear mounted on said eccentric member radially outwardly of said thrust bearing;

a crusher head assembly positioned below said crusher bowl assembly and generally around said eccentric member, said crusher head assembly having an upwardly presented crushing surface;

second bearing means between said crusher head assembly and said eccentric member to enable said eccentric member to rotate within said crusher head assembly; the axis of said second bearing means being oblique to the axis of said first bearing means, whereby said crusher head assembly will wobble as said eccentric member rotates; said bowl assembly having an inlet located above said crusher head assembly so that material to be crushed may be directed through the inlet and toward the crusher head assembly;

said bowl assembly including a downwardly presented crushing surface located in a generally fixed position with respect to said crusher head assembly, said crushing surface being positioned in a spaced relation to the crushing surface on said head assembly, whereby material introduced into the housing through the inlet will be crushed in the space between the two crushing surfaces as the crusher head assembly wobbles.

12. The crusher according to claim 11 wherein said second bearing means includes a tapered roller bearing surrounding the first portion of said eccentric member and a radial bearing surrounding said second portion of the eccentric member, the tapered roller bearing being positioned to transmit thrust loads from the crusher head assembly to said eccentric member.

13. A crusher according to claim 12 wherein the outside diameter of the tapered roller bearing surrounding said eccentric member is greater than the outside diameter of the thrust bearing supporting said eccentric member on said shaft.

14. The crusher according to claim 12 wherein the first bearing means includes a pair of radial bearings having the same dimensions as the radial bearing insaid second bearing means whereby said radial bearings are interchangeable.

15. The crusher according to claim 11 including means connected between said shaft and said crusher head assembly for preventing rotation of said crusher head assembly in the same direction as said eccentric member.

* * * * *